US006813364B1

(12) United States Patent
Vonlanthen

(10) Patent No.: US 6,813,364 B1
(45) Date of Patent: Nov. 2, 2004

(54) ELECTRIC/ACOUSTIC TRANSDUCER MODULE, IN-EAR HEARING AID AND METHOD FOR MANUFACTURING AN IN-EAR HEARING AID

(75) Inventor: Andi Vonlanthen, Remetschwil (CH)

(73) Assignee: Phonak AG, Stafa (CH)

( * ) Notice: Subject to any disclaimer, the term of this patent is extended or adjusted under 35 U.S.C. 154(b) by 204 days.

(21) Appl. No.: 09/587,864

(22) Filed: Jun. 6, 2000

Related U.S. Application Data

(63) Continuation-in-part of application No. 09/340,915, filed on Jun. 28, 1999.

(30) Foreign Application Priority Data

Jun. 16, 1999 (WO) ..... PCT/CH99/00260

(51) Int. Cl.[7] ..... H04R 25/00

(52) U.S. Cl. ..... 381/322; 381/345; 381/324; 381/325; 381/330; 381/381; 181/158

(58) Field of Search ..... 381/345, 392, 381/322, 324, 325, 328, 330, 380, 381; 181/158

(56) References Cited

U.S. PATENT DOCUMENTS 3,257,516 A * 6/1966 Knowles
4,051,330 A * 9/1977 Cole
4,620,605 A 11/1986 Gore et al.
5,101,543 A * 4/1992 Cote
6,164,409 A * 12/2000 Berger
6,574,343 B1 6/2003 Meier

FOREIGN PATENT DOCUMENTS

| | | |
|---|---|---|
| DE | 87 13 089 | 1/1989 |
| DE | 94 08 054 | 7/1994 |
| EP | 0 548 580 | 6/1993 |

* cited by examiner

*Primary Examiner*—Huyen Le
*Assistant Examiner*—Dionne Harvey
(74) *Attorney, Agent, or Firm*—Pearne & Gordon LLP

(57) ABSTRACT

A transducer module for integration into a hearing aid device. The transducer module has an encapsulation with an opening and a transducer housing resiliently mounted in the encapsulation. The transducer module also has a first membrane and a second membrane. The first membrane forms a first space adjacent to a first side of the membrane which communicates with the opening. The first membrane also forms a second space adjacent to a second side of the first membrane which communicates with an intermediate space between the transducer housing and the encapsulation. The second membrane is for closing the opening of the encapsulation. Further, the transducer forms a self-contained module with the encapsulation as a housing of the module, with the module being adapted for insertion into the hearing device.

18 Claims, 5 Drawing Sheets

Figure 1:
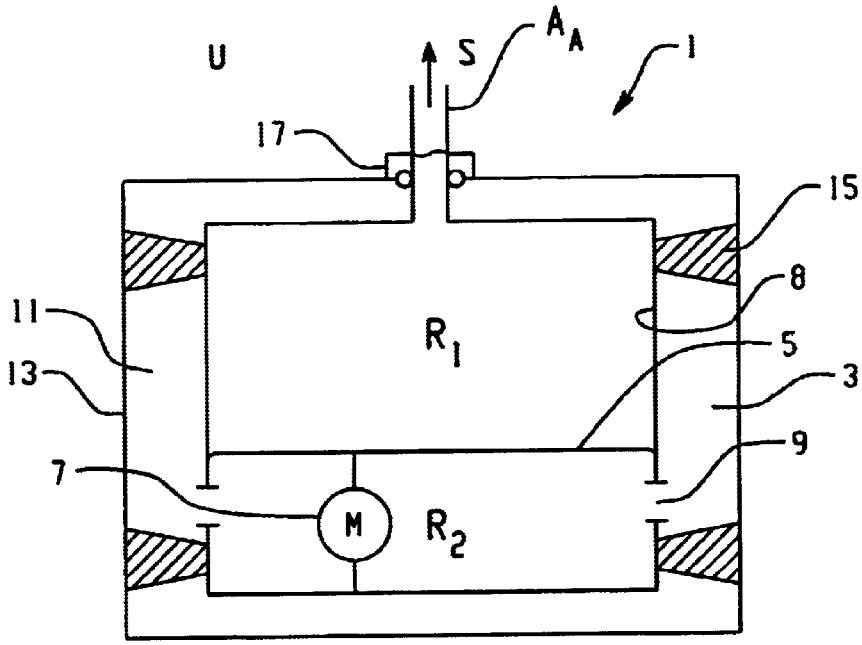

ELECTRIC/ACOUSTIC TRANSDUCER MODULE, IN-EAR HEARING AID AND METHOD FOR MANUFACTURING AN IN-EAR HEARING AID

This application is a continuation-in-part of U.S. application Ser. No. 09/340,915, filed Jun. 28, 1999 which is a §371 of PCT Application Ser. No. PCT/CH99/00260, filed Jun. 16, 1999.

The present invention relates to an electric/acoustic transducer module for behind-the-ear or in-ear hearing aids as defined in the preamble of claim 1, further an in-ear hearing aid as defined in the preamble of claim 10 and a manufacturing method for such an in-ear hearing aid as defined in the preamble of claim 21.

As regards hearing aids and in particular in-ear hearing aids, care must be taken to preclude the loudspeaker housing from being connected by a mechanically rigid bridge to the auditory canal in order that acoustic feedback from the loudspeaker to the receiving microphone shall be eliminated as far as possible. Furthermore the space available to hearing aids in general will be exceedingly limited and must be used optimally.

Illustratively the European patent document 0 548 580 discloses fitting the electric/acoustic transducer system of an in-ear hearing aid with a loudspeaker housing, the motor-driven loudspeaker diaphragm and the motor drive being appropriately supported. Said diaphragm or the motor drive are so supported relative to said loudspeaker housing that the diaphragm-driven acoustic signals are directly transmitted to said loudspeaker housing. The said assembly is so configured in an in-ear hearing-aid housing that this loudspeaker housing shall be as far away as possible from said hearing-aid housing, whereby only reduced acoustic transmission bridges are formed. As a result, however, assembly of the heretofore known hearing aids demands meticulous care that such bridges shall not form, that is, a transducer system must be inserted manually, as is actually the case in practice, into the hearing-aid housing and therein it must be aligned most carefully.

The objective of the present invention is elimination of the above drawbacks. To that end the electric/acoustic transducer module is characterized by the features of claim 1.

Because the loudspeaker housing is resiliently supported in the enclosure, the transducer module can be integrated in geometrically locking and even in frictionally locking manner into a behind-the-ear or in-ear hearing aid. Furthermore the gap already cited and anyway required between the housings of the loudspeaker and of the hearing aid now shall be exploited to acoustically improve the hearing-aid behavior. This goal is attained in that the gap which the invention places at the transducer itself shall raise the bass range of the transducer module by several dB because the said gap acoustically enlarges by a multiple the chamber at the rear of the diaphragm when compared with this rear chamber in the loudspeaker housing per se. Reference is made in this respect to U.S. Pat. No. 3,257,516 which discusses the advantages of large rear chambers.

In one preferred embodiment, the enclosure acts as a magnetic shield and for this purpose is preferably made of mu-metal. Very simple assembly and disassembly of the transducer system, in particular the insertion of the loudspeaker housing together with the loudspeaker, is attained in that the enclosure comprises a cup-shaped component which preferably is metallic. In a further preferred embodiment, and following insertion of loudspeaker housing with loudspeaker, this cup-shaped element is sealed by a cover comprising the transducer system's acoustic output which comprises the transducer system's acoustic output. In a far more preferred embodiment, said cover element comprises an aperture where, by means of a membrane, the first chamber on one side of the loudspeaker diaphragm, that is that chamber which is coupled to the acoustic output of the transducer system, is separated from the ambience. Said membrane is situated in unhampered manner across the aperture. In another embodiment, the cup is complemented by hose-like elastomeric cover. Both designs practically achieve sealing the inside of the transducer module, this feature being highly desirable in particular as regards the known soiling of acoustically significant transmission elements of in-ear hearing aids. Said designs at once allow removing such soiling from the transducer module. Neither dirt nor moisture can enter the module.

The membrane of the above preferred embodiment differs from the corresponding design in the aforementioned European patent document 0 548 580 by being mounted in freely vibrating manner and not being motor-driven. By expertly dimensioning the acoustically effective chambers of the invention and expertly determining the membrane characteristics in the sense of impedance matching, the invention achieves virtually precluding said membrane from affecting the hearing-aid's transmission characteristics at the transmission side of the loudspeaker.

In an especially preferred embodiment of the invention, at least the unobstructed portion of the membrane shall be homogeneous in its material and in a further preferred feature shall be of constant thickness. This design offers minimal effort in driving the cited membrane and allows overviewing the acoustic behavior of this membrane.

In a preferred embodiment, at least the free portion of the cited membrane shall be made of an elastomeric material such as latex or silicone rubber, further it shall be most economical and uniform and thin, tough and unobjectionable as regards being in contact with living tissue. Preferably the membrane shall be airtight. Its thickness preferably is $d \leqq 0.09$ mm.

Furthermore, to allow installing the loudspeaker housing in a most simple manner in the enclosure while preserving the decoupling of loudspeaker housing and enclosure, the invention proposes supporting the loudspeaker housing by means of elastic supports in said enclosure. Also, to optimally exploit said gap, a further embodiment proposes that the said gap shall omnidirectionally enclose the loudspeaker housing except for this loudspeaker housing's support sites on the said enclosure.

The in-ear hearing of the invention comprises an electric/acoustic transducer system of the above discussed kind. The potential for simple assembly is exploited to the fullest in that the transducer module's enclosure is configured in geometrically and/or frictionally locking manner in the hearing-aid housing.

As a result and as shall be elucidated further below, such hearing aids may be manufactured in automated manner: the problem of avoiding acoustic bridges between the housings of the loudspeaker and of the hearing-aid is solved a priori by installing the transducer module of the invention.

In this respect and in a preferred embodiment of the invention, the transducer module's acoustic output can be conventionally connected by a tubular stub to the acoustic output of the hearing-aid housing.

In another preferred embodiment of in-ear hearing aid of the invention, a membrane is always used which is mounted so as to be vibrating in unhampered and undegraded manner and which separates the hearing-aid ambience from the first chamber at the transducer module of the invention. This membrane obviously can consist of the previously cited membrane itself at the transducer system, though this feature is not mandatory, and in all cases the pertinent embodiment modes shall apply. On the other hand, in a further preferred embodiment, the said membrane is directly mounted in the vicinity of the acoustic output of the hearing aid. In this way soiling penetrations are reliably precluded not only into the transducer module but also into the hearing aid's transducer input.

Therefore, in a further preferred embodiment of the hearing aid of the invention, the acoustic output of the transducer module of the invention is essentially situated directly at the output aperture of the hearing-aid housing, whereby said membrane, if preferably provided, is directly situated in the environment of the hearing-aid housing on one hand and directly at the transducer module's output on the other hand. Accordingly, and as already mentioned, on one hand the problem of dirt collecting at an output aperture of the hearing aid is being solved in that said aperture is directly sealed by said membrane, and on the other hand the feasibility is provided to optimize the acoustic behavior in the sense that no additional, intermediary transmission paths are needed between the transducer module's output and the acoustic hearing-aid output. The remaining acoustic transmission path can be designed solely considering impedance matching.

In an especially preferred design of the hearing aid, the acoustic output of the hearing-aid housing consists of a lamellar element connected for instance by welding or bonding to the remaining hearing-aid housing. Preferably this design also shall include sealing said output aperture using a membrane which now however shall be preferably integral with said element. The above cited considerations also apply to this membrane, and as a consequence said element preferably shall consist of an elastomeric material such as latex or silicone rubber.

The method of the invention for manufacturing a hearing aid, in particular an in-ear hearing aid of the invention, is characterized in that the transducer module is configured in geometrically or frictionally locking manner inside the hearing-aid housing. As a result, the transducer module can be accurately positioned at little effort in the hearing-aid housing, or it may even be force-fitted between portions of the hearing-aid housing, or illustratively this transducer module may be cast jointly with the hearing-aid housing.

As a result, the preferred implementation of the above method shall be made possible, that is, to insert in automated manner the transducer module into the hearing-aid housing.

In another preferred implementation, the transducer module is inserted through an aperture constituting the acoustic output of the hearing-aid housing, that is, from below, into said housing. This feature allows a further procedure, namely positioning the transducer module into a seating aperture of a support plate and, by means of a relative motion between the support plate and the hearing-aid housing, inserting the transducer module from the acoustic output of the hearing-aid housing into this housing. The automation so made feasible is quite clear to the expert: a plurality of receiving apertures in said support plate shall receive the corresponding number of transducer modules which are inserted from below into a corresponding number of housings of in-ear hearing aids to be manufactured.

In a further preferred implementation of the invention, the support plate subsequently is used as a portion of the hearing-aid housing by being connected to it, preferably by bonding or welding and thereupon being trimmed off along the outside contour of the hearing-aid housing.

In another preferred implementation of the method of the invention, the receiving aperture for the transducer module to be seated in the support plate takes the form of a blind aperture, as a result of which and in a further preferred implementation, the base of the blind aperture shall constitute the above-mentioned membrane which is integral with the support plate or mounted on it as a sheet-like structure. If the cover of the blind aperture shall be the membrane as discussed above, and being integral with the support plate, then, clearly this support plate is also made of a material meeting the requirements of a membrane material, that is, it shall preferably be elastomeric, for instance a latex or silicone rubber.

The invention is elucidated illustrative manner below in relation to the attached Figures.

Figure 2:
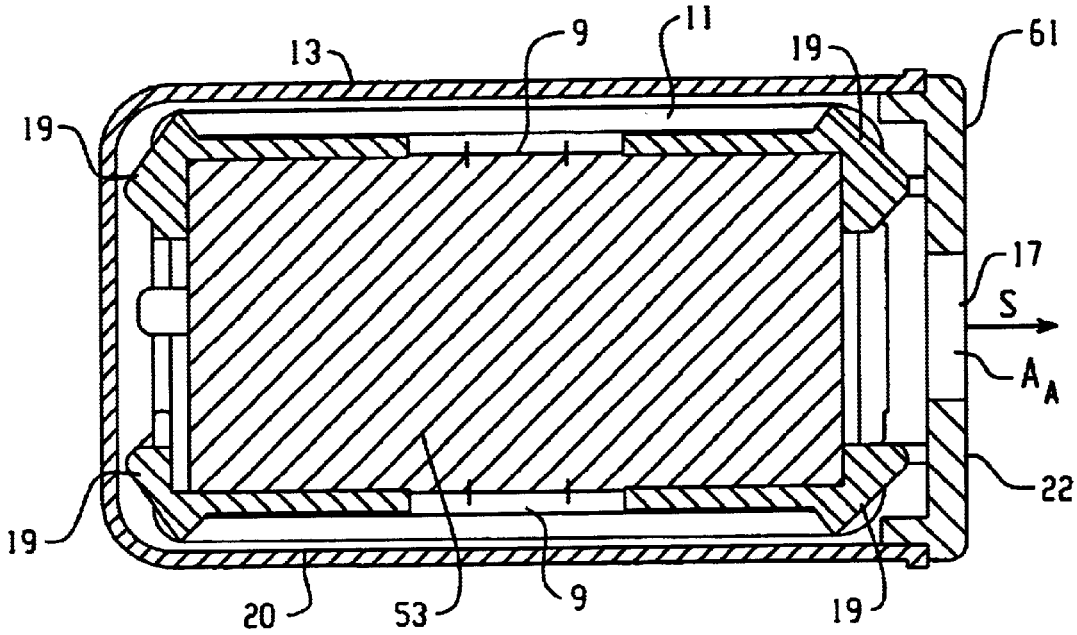
Figure 2A:
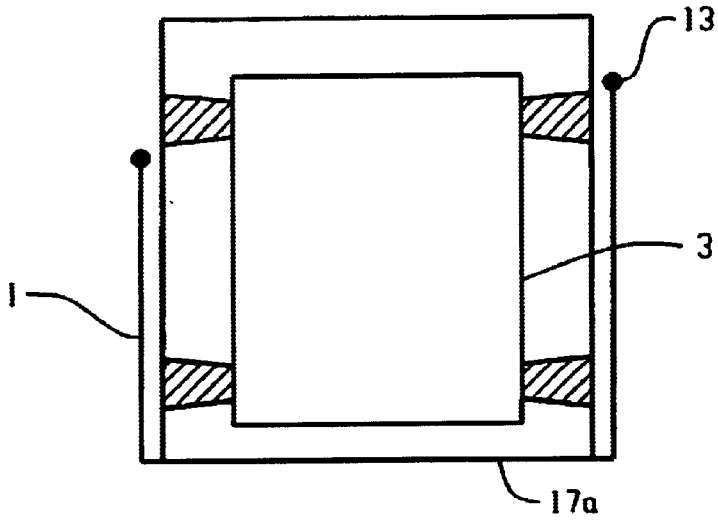
Figure 3:
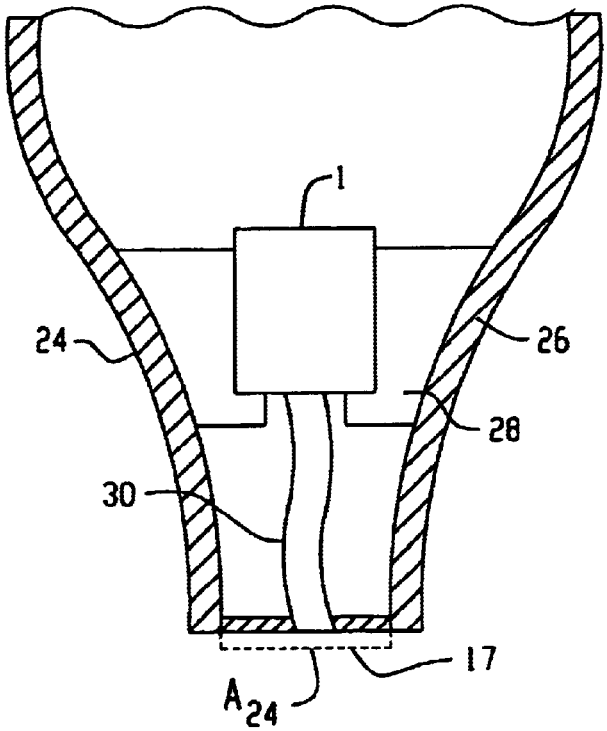
Figure 4:
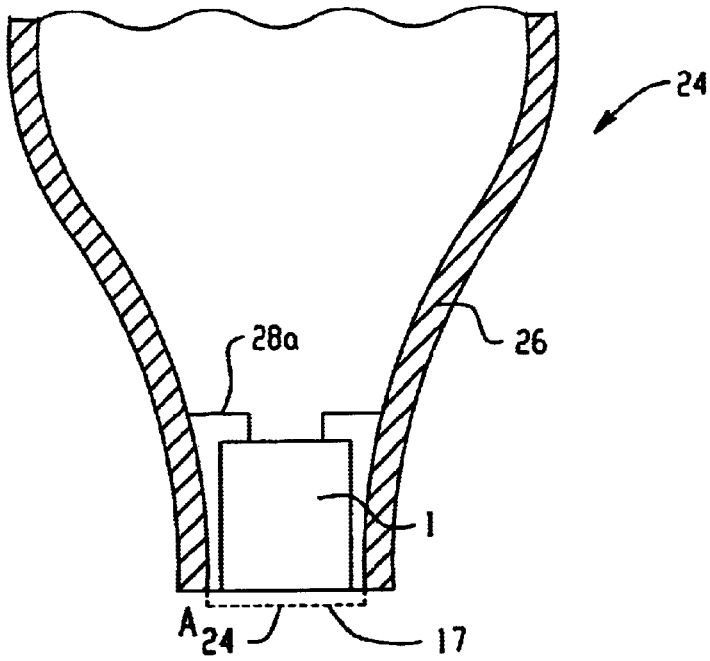
Figure 5:
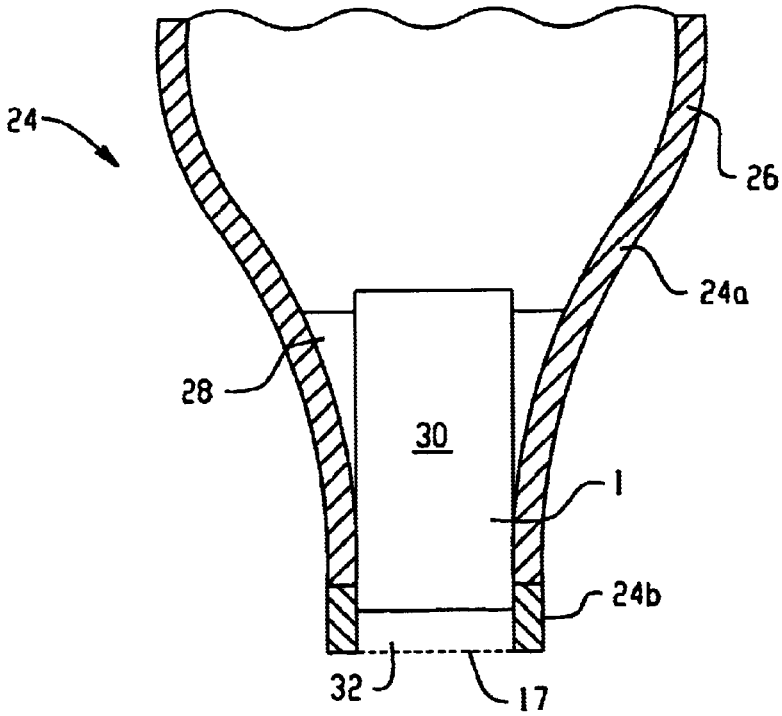
Figure 6A:
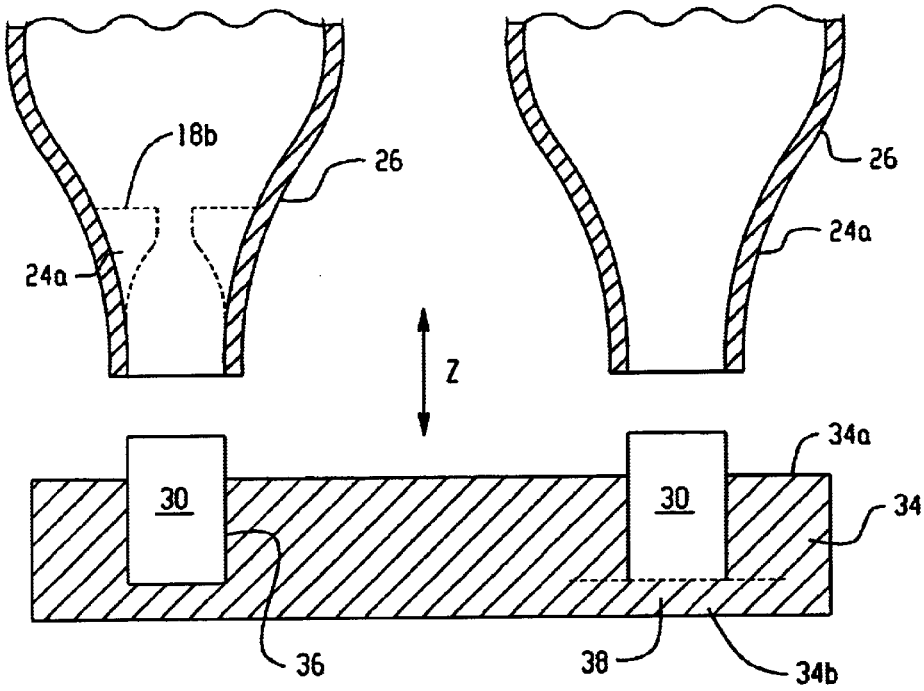
Figure 6B:
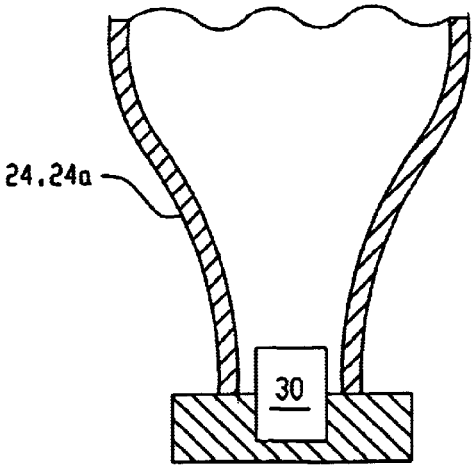
Figure 6C:
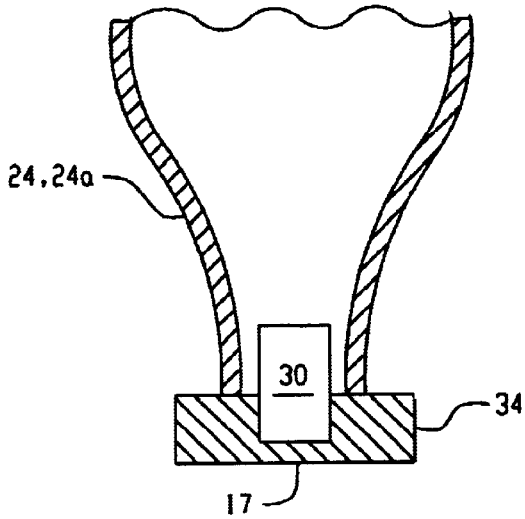
Figure 7:
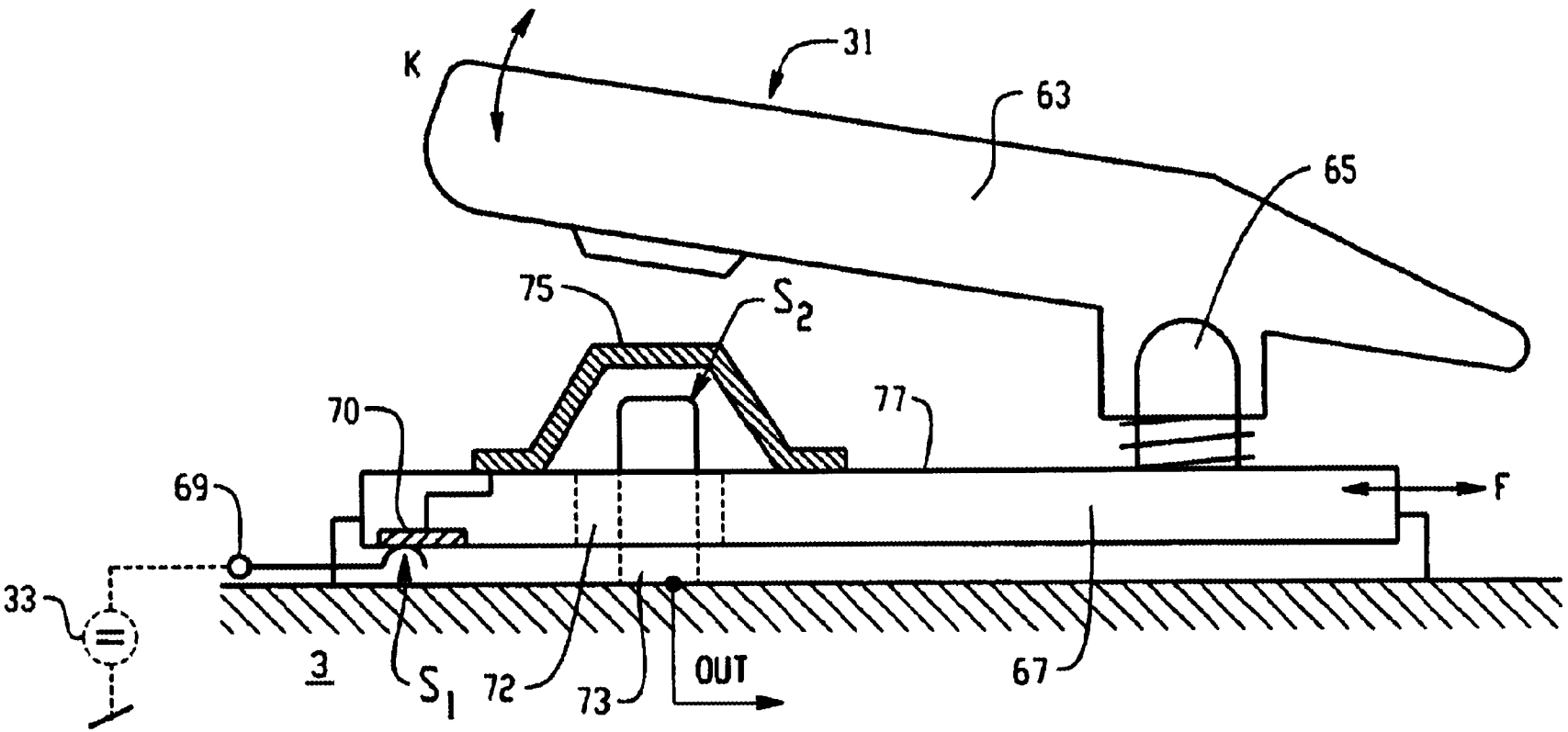

FIG. 1 is a schematic of a transducer module of the invention,

FIG. 2 is a schematically simplified longitudinal section of a transducer module of the invention, FIG. 2*a* schematically shows a further, preferred embodiment of the transducer module of the invention, FIG. 3 further schematically shows the integration of a transducer module of the invention into an in-ear hearing aid, FIG. 4 is a view similar to FIG. 3 of another integration of a transducer module of the invention into an in-ear hearing aid, FIG. 5 is a view similar to FIG. 3 or FIG. 4 of another embodiment variation of an in-ear hearing-aid's portion constituting the acoustic hearing-aid output, and FIGS. 6*a*–6*c* schematically show the sequence of a manufacturing process of an in-ear hearing aid as regards assembling the electric/acoustic transducer module and the hearing-aid housing.

FIG. 1 diagrammatically shows a transducer module serving herein to elucidate the principles of acoustic coupling of this hearing aid. The transducer module 1 comprises a loudspeaker housing 3 wherein is supported the loudspeaker diaphragm 5. This loudspeaker diaphragm 5 is powered by a motor drive 7 merely indicated in schematic manner. The loudspeaker diaphragm 5 divides the loudspeaker housing 3 into a front chamber R1 and a rear chamber R2. One of the two cited chambers, for instance the rear chamber R2, is acoustically coupled through acoustic coupling apertures 9 with an acoustic gap 11 subtended between the loudspeaker housing 3 and the enclosure 13. The enclosure 13 and hence the gap 11 substantially entirely enclose the loudspeaker housing 3 except for elastic braces 15 by means of which the loudspeaker housing is spaced and supported in substantially "floating" manner within the enclosure 13. As shown in FIG. 1, the front chamber R1 communicates with the acoustic output $A_A$ of the transducer module 1.

In this design, on account of the substantially free-floating support of the loudspeaker housing 3 in the enclosure 13, the loudspeaker effect on the enclosure 13 is acoustically decoupled from this enclosure. By significantly enlarging the rear diaphragm chamber R2, namely by including the gap 11, the acoustic behavior of the transducer module 1 is significantly improved over that of the loudspeaker system in the housing 3: the bass of the transducer module is raised by several dB compared to the bass of the loudspeaker system in the housing 3.

In a preferred embodiment of the transducer module 1 invention, this very module shall be fitted with a membrane, as diagrammatically indicated by 17, at the acoustic output $A_A$. Except for being clamped at its rim, the membrane 17 is vibrates freely. Preferably this membrane is made of a homogeneous material, preferably a elastomeric material such as latex of silicone rubber, and in a further preferred manner, its thickness is constant and about 100$\mu$, preferably no more than 0.09 mm.

By matching the acoustic impedance of the gap 11 to the chamber R2, of the chamber R1 as far as the membrane 17, of the membrane 17 and any acoustic conductor that might be provided to propagate toward the environment U of the transducer module 1, the membrane 17 is practically acoustically transparent.

FIG. 2 is a cross-section of one embodiment of the transducer module 1. The references already used in the diagram of FIG. 1 are used herein also. The loudspeaker housing 3 comprising the coupling apertures 9 is supported by elastomeric bearings 19 on the enclosure 13. The enclosure 13 is constituted by a cup 20 preferably simultaneously acting as a magnetic shield and for that purpose preferably being made of mu-metal. In any event the cup 20 preferably shall be metallic. The cup 20 is sealed by a cover 22. The membrane 17 already shown in FIG. 1 may be mounted directly on the cover 22. Furthermore the cover 22 and the membrane 17 may very well be integral, in which case however the material of the cover 22 must meet the material requirements of the membrane, for instance regarding elastomeric behavior. Illustratively the entire component 22 shall be made of latex or silicone rubber. Otherwise the membrane 17 is anchored as a separate element on the cover 22. However the membrane 17 also may be fitted between the acoustic output $A_3$ in the loudspeaker housing 3 and the aperture in the cover 22. Preferably however, as shown in FIG. 2, the membrane 17 is trimmed to be flush with the aperture in the cover 22, whereby the transducer module 1 as a whole shall be a unit which is sealed and encapsulated per se and which can be cleaned very easily. Such a feature is especially significant if, as shall be discussed further below, the output $A_A$ of the transducer module 1 is situated directly at the acoustic output of a hearing aid.

The transducer module, or its enclosure 13, can be cubic, cylindrical or assume another, arbitrary shape, provided that the required gap 11 substantially enclosing the loudspeaker housing 3 shall be subtended by the loudspeaker housing 3 and the enclosure 13. Based on the discussion relating to FIG. 2, FIG. 2*a* shows another embodiment, in merely diagrammatic form. Therein an elastomeric sleeve 17*a* is pulled over the enclosure 13. Said sleeve 17*a* simultaneously constitutes the cover 22 and the membrane 17.

FIG. 3 diagrammatically shows the segment comprising the output aperture $A_{24}$ of an in-ear hearing aid 24. The transducer module 1 of FIGS. 1, 2 or 2*a* is integrated into the hearing-aid housing 26, namely being situated and kept in position in frictionally or geometrically locking manner by means of straps 28, in the hearing-aid's housing 26. This feature is made possible by decoupling the enclosure 13 from the loudspeaker housing 3 in the transducer module in the manner discussed in relation to FIGS. 1, 2 and 2*a*. Otherwise the design of the in-ear hearing aid of FIG. 3 is substantially the same as the known designs because the acoustic output of the transducer module 1 is connected by a tubular stub 30 to the acoustic output aperture $A_{24}$ of the hearing aid.

The electronic components and the input-side acoustic/electrical transducer system at the in-ear hearing aid 24 comprising the housing 26 are omitted from FIG. 3 and the further Figures because not being essential to the invention.

As further shown in FIG. 3, the membrane 17 used in the preferred embodiments is integrated in the immediate vicinity of the acoustic output $A_{24}$ in the hearing-aid housing 26.

In FIG. 4, the transducer module 1 is mounted in frictionally or geometrically locking manner in the immediate vicinity of the acoustic output $A_{24}$ of the hearing aid 24, ie. of the housing 26 as indicated by the diagrammatically shown supports 28*a*. In a preferred embodiment mode, the freely vibrating membrane 17 is mounted terminally.

As shown in FIG. 5, the housing 26 of the in-ear hearing aid 24 consists of a main housing part 24*a*, whereas a laminar cover 24*b* is set terminally on the component 24*a* onto which it is bonded or welded. A transducer module 1 described in relation to FIGS. 1 and 2—or one fitted directly to the loudspeaker housing of a loudspeaker system of the prior state of the art, which in FIG. 5 includes both and is denoted by 30—is seated in the output aperture 32 of the cover 24*b* where it is affixed by clamping, bonding etc. If the transducer module 30 shown in generalized form in FIG. 5 is fitted with an enclosure, that is designed in the manner of FIGS. 1 and 2 or 2*a*, then the hearing-aid housing 26 may again contain positioning and affixation elements again denoted by 28 for said transducer module 1.

A preferred membrane of the above described kind is denoted by 17 also in FIG. 5 in a preferred position. As discussed further below, the design of FIG. 5, whether applied to hearing aids comprising a transducer module as shown in FIGS. 1, 2, 2*a* or whether applied to previously known transducer systems, that is with a loudspeaker housing directly on the outside, does offer substantial advantages. Moreover the membrane 17 may be integral with the component 24*b*, and in particular the material selection regarding the portion 24*b*, which is separate from the remaining housing 26, can be matched to the requirements placed on the membrane 17.

FIGS. 6*a* through 6*c* schematically show the sequence of a manufacturing method of in-ear hearing aids.

As shown in FIG. 6*a*, preferably blind apertures 36 are present in a support plate 34 and receive the transducer systems 30 of the in-ear hearing aids. If these transducer systems 30 are conventional, that is, if comprising an external loudspeaker housing and lacking an enclosure as shown in FIGS. 1, 2, 2*a*, then the transducer systems 30 preferably shall be firmly anchored in the support plate 34, for instance by bonding. If on the other hand the transducer systems do comprise external enclosures as shown in FIGS. 1, 2, 2*a*, then the systems 30 need not be kept firmly joined to the support plate 34, because, as already discussed and as shown at 28*b* in dashed lines, they may be affixed in frictionally or geometrically locking manner in the corresponding hearing-aid housings 24*a*. It is of foremost significance as regards the procedure that on account of relative motion of the plate 34 bearing the transducer systems 30 and a corresponding number of housing parts 24*a*, the transducer systems 30 shall not be inserted in the conventional manner from above, but instead from below into those segments of the housing parts 24*a* which face the acoustic output.

In case the transducer systems 30 are designed with enclosures, then, after the transducer systems 30 have been inserted in affixed manner into the housings 26, the support plate 34 may be removed, the transducer systems or modules being positioned and held in place in the housings 24*a*. On the other hand if transducer systems lacking an encapsulation are involved, the transducers 30 remain in the assigned apertures 36 of the plate 34. The plate 34 is connected to the housing 24*a* for instance by bonding or welding, and, based on the position of FIG. 6*b*, the plate 34 then is trimmed to become flush with the external housing contour (transition to FIG. 6*c*).

The result is the in-ear hearing aid shown in FIG. 5. However this procedure is preferred for transducer modules designed in the manner of FIGS. 1, 2, 2*a*, that is fitted with an enclosure.

Observation of FIG. 6 shows that this procedure is unusually well suited to integrate the membrane 17 or another preferred one to act both as soil protection for the acoustic hearing-aid output and as a means assuring simple cleaning. For that purpose the base plate 38 of FIG. 6*a* of the apertures 36, which preferably shall be blind holes, shall be directly formed as the membrane. Implementation takes place either by selecting the material of the support plate 34 to match the requirements set on the membrane material and hence designing integrally with the plate 34, or, as shown in dashed lines in FIG. 6*a*, by forming the blind holes 36 first by laminating the support plate 34, the apertures still being open end to end, with a sheet 34*b* or the like which then constitutes the membrane 17 of FIG. 5.

The above discussed manufacturing method allows assembling both transducer modules as shown in FIGS. 1, 2, 2*a* and also conventional transducer systems, that is comprising an external loudspeaker housing, in the in-ear hearing aid housing, without need for laborious positioning maneuvers. Said assembly can be implemented from that side where the acoustic output is situated. As a result substantially automated assembly is made possible. If, as preferred, the acoustic hearing-aid output shall be protected against soiling from the environment, and allow good cleaning, it is also simultaneously feasible to integrate a covering membrane 17 as discussed above.

What is claimed is:

1. A transducer arrangement with a size enabling integration into a hearing aid device and comprising:

an encapsulation with an opening;

a transducer housing resiliently mounted in said encapsulation and defining an intermediate space between said transducer housing and said encapsulation;

a first membrane in said transducer housing having a first side and a second side;

a second membrane closing said opening;

a first space adjacent to said first side of said membrane and communicating with said opening;

a second space adjacent to said second side of said first membrane and communicating with said intermediate space, wherein said transducer forms a self-contained module with said encapsulation as a housing of said module and defines a predetermined volume of said intermediate space, and wherein said module is adapted for insertion into an additional space formed by a device housing of the hearing device.

2. The module of claim 1, being an electrical/mechanical transducer module.

3. The module of claim 1, said encapsulation forming a magnetic shield, and comprising $\mu$ metal.

4. The module of claim 1, wherein said encapsulation comprises a cup-shaped member and a closing member for said cup-shaped member.

5. The module of claim 4, wherein said second membrane is applied to said closing member.

6. The method of claim 5, wherein said second membrane is one piece with the closing member.

7. The module of claim 4, wherein said cup-shaped member is removable from said closing member.

8. The module of claim 1, wherein said transducer housing is resiliently mounted in said encapsulation by elastic mounting members.

9. The module of claim 1, wherein said transducer housing and an inner surface of said encapsulation are substantially cube shaped, edges of the transducer housing and of the inner surface of said encapsulation being substantially parallel, said transducer housing being mounted within said encapsulation by resilient mounting blocks bridging said transducer housing and said inner surface of said encapsulation along at least parts of respective edge areas.

10. The module of claim 1, wherein the intermediate space substantially surrounds said transducer housing.

11. The module of claim 1, wherein said encapsulation is sealed.

12. The module of claim 1, wherein said second membrane is, at least substantially, acoustically ineffective.

13. The module of claim 1, wherein at least the part of said membrane bridging said opening is of a homogenous material.

14. The module of claim 1, wherein at least the part of said second membrane, bridging said opening, is of constant thickness.

15. The module of claim 14, wherein said thickness is at most 0.09 mm.

16. The module of claim 1, wherein at least the part of the second membrane, bridging said opening, is of an elastomeric material.

17. The module of claim 1, wherein said second membrane is replaceable.

18. The module of claim 1, wherein said second membrane includes an elastic material.

* * * * *

UNITED STATES PATENT AND TRADEMARK OFFICE

CERTIFICATE OF CORRECTION

PATENT NO. : 6,813,364 B1
DATED : November 2, 2004
INVENTOR(S) : Andi Vonlanthen It is certified that error appears in the above-identified patent and that said Letters Patent is hereby corrected as shown below:

Column 1,
Lines 7-9, please delete "which is a §371 of PCT Application Ser. No. PCT/ CHll9/00260, filed Jun. 16, 1999".

Column 5,
Line 3, please delete "is".

Signed and Sealed this

Fifteenth Day of November, 2005

JON W. DUDAS
*Director of the United States Patent and Trademark Office*